US006981920B1

(12) United States Patent
Kosnitzky

(10) Patent No.: US 6,981,920 B1
(45) Date of Patent: Jan. 3, 2006

(54) MAGIC TRICK DEVICE AND METHOD

(76) Inventor: Gary Kosnitzky, 3823 S. Maryland Pkwy., #K6, Las Vegas, NV (US) 89119

( * ) Notice: Subject to any disclaimer, the term of this patent is extended or adjusted under 35 U.S.C. 154(b) by 0 days.

(21) Appl. No.: 10/890,560

(22) Filed: Jul. 12, 2004

Related U.S. Application Data

(60) Provisional application No. 60/487,045, filed on Jul. 11, 2003.

(51) Int. Cl.
*A63J 21/00* (2006.01)

(52) U.S. Cl. ..... 472/71; 472/81

(58) Field of Classification Search ..... 472/51, 472/54, 55, 70, 71, 75, 81, 137

See application file for complete search history.

(56) References Cited

U.S. PATENT DOCUMENTS 1,010,794 A * 12/1911 Petrie ..... 472/71
1,187,812 A * 6/1916 Burke ..... 472/54
2,176,675 A * 10/1939 Loeffler ..... 472/55
5,071,114 A * 12/1991 Persaud et al. ..... 472/70

OTHER PUBLICATIONS http://www.parmountzone.com/bartricks.hmt, Nov. 22, 2001, 4 pages.*
http://www.25offmagic.com/, Dec. 17, 2003, 5 pages.*

* cited by examiner

*Primary Examiner*—Kien Nguyen
(74) *Attorney, Agent, or Firm*—Robert Ryan Morishita; Anderson & Morishita, LLC

(57) ABSTRACT

A magic trick device and method are set forth to provide the illusion of a performer inserting a cigarette into his nostril. The device includes a body with a slidable sleeve and a pull tether to withdraw the device into a coat sleeve, vest or shirt.

9 Claims, 2 Drawing Sheets

MAGIC TRICK DEVICE AND METHOD

RELATED APPLICATION DATA

This application claims the benefit of U.S. Provisional Patent Application Ser. No. 60/487,045, entitled "Cigarette Up The Nose," filed Jul. 11, 2003 by Applicant herein.

FIELD OF THE INVENTION

The present invention relates to magic trick devices and methods and more particularly to such tricks which use a "pull" methodology.

BACKGROUND OF THE INVENTION

Magic tricks and devices have long been used to entertain audiences. In an early publication titled "Scots Discovery of Witchcraft" (1651) there is disclosed a magic trick methodology referred to herein as retraction where one portion of an object is retracted into another to produce the illusion of movement. In the Scots reference there is disclosed a "bodkin" where a blade portion is retracted into a handle to produce the illusion of the blade penetrating the body.

Another methodology for producing a different effect from retraction is referred to as a "pull." In a "pull" trick, a line is attached to an object. The line is biased, such as by having a weight attached to one end to fall within the magician's coat or pant leg or by using an elastic line. The magician holds the object, e.g. a handkerchief, against the bias and at the appropriate time releases the object at which time. As a result of the bias of the line, the object is pulled into a coat sleeve or vest to produce the illusion that the object has disappeared.

Heretofore the methodologies of retraction and pull have been mutually exclusive. That is, a retraction trick need not employ a pull since the very illusion produced by the retraction was sufficient to produce the desired illusion. Conversely, a pull trick was thought to be sufficient in its own right without adding a retraction. To my knowledge no one has combined the retraction and pull concepts or methodologies into a single magic trick illusion.

SUMMARY OF THE INVENTION

There is, therefore, set forth according to the present invention a magic trick device and method for a performer to perform an illusion of inserting a stick object into another object which could be a nostril, ear, mouth or other object. The device includes the stick object having a rigid body with a first end and a second end and a distinguishable sleeve member slidable along the body from a first position to a position proximate the second end. A pull including a tether is coupled to the object at the first end and is adapted to extend through the sleeve, vest pant leg or other part of the clothing component of the performer.

The performer holds the object exposed in one hand with the second end at the ear or nostril while moving the sleeve member along the body toward the second end to invoke the illusion of insertion of the object. The pull includes means for exerting a force by the tether on the object to pull the object into the sleeve for concealment thereof upon release of the object from the one hand.

The pull tether may be elastic such that the tether is elastically stretched when the object is held exposed and elastically contracts to withdraw the object into the sleeve.

The bias of the pull may also be exerted by a weight, coil spring or other means for retracting the object.

In one embodiment the object is in the form of a filter cigarette with the sleeve configured to appear as the filter. In another embodiment the object is in the form of a pen with the sleeve configured to appear as a cap for the pen.

DESCRIPTION

Figure 1:
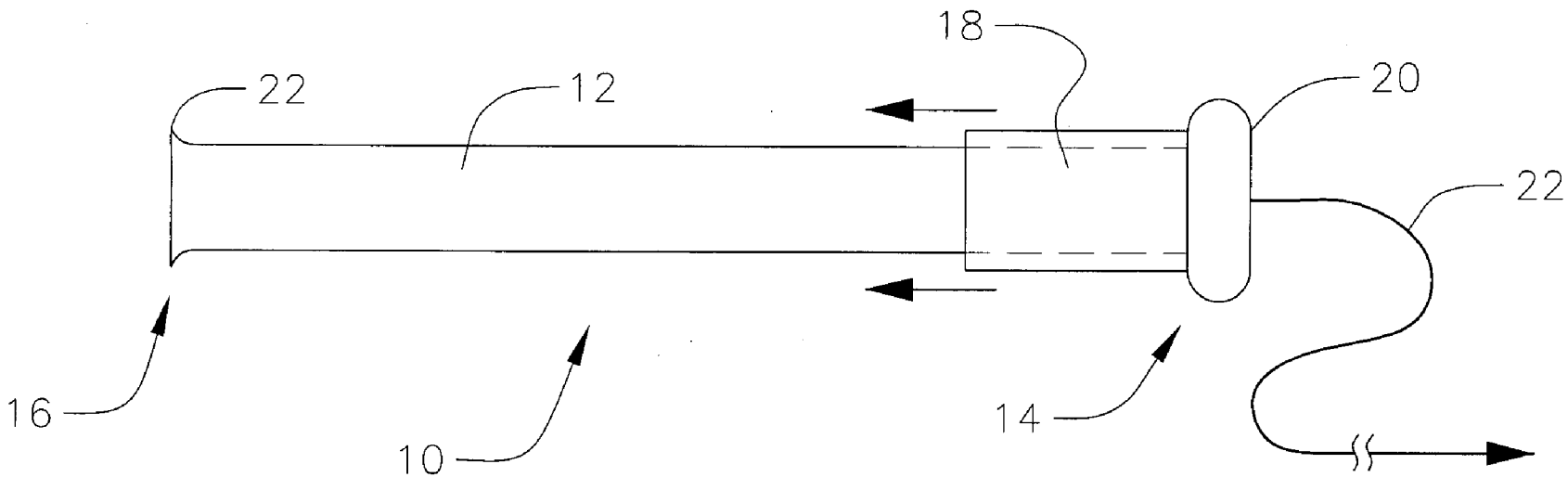
FIG. 1 shows an enlarged view of one embodiment of an object according to the present invention.

Reference is now made to the figures wherein like parts are referred to by like numerals throughout. Turning to FIG. 1 there is shown a device 10 according to the present invention embodied as a facsimile of a filter cigarette. While the following description is directed to the device 10 in the form of a cigarette it should be understood that the device could as well be a pencil, pen, wand or any other stick object.

The device 10 includes a rigid body 12 having a first end 14 and a second end 16. A sleeve 18 is moveably disposed on the body 12 for movement between the first and second ends 14, 16. To retain the sleeve 18 on the body 12, the first end 14 includes a plug 20 which may be secured to the body 12 by a press-fit, adhesive, staking or any other suitable attachment means. As can be appreciated in FIG. 1 the plug 20 is slightly enlarged from the body 12 to define a stop for the sleeve 18. The second end 16 may include a slight flare 22 also adapted to define a stop for the sleeve 18.

In the embodiment shown, the body 12 is presented as a cigarette with the sleeve 18 having a different color to appear as the filter for the cigarette. For example, the body 12 may be white in color with the sleeve 18 being a brown or tan. As can be appreciated, when properly exhibited, the movement of the sleeve 18, in this optional embodiment depicted as a cigarette filter, along the body 12 will produce an illusion of a retraction as more fully described herein.

To provide the "pull," a line tether 22 is attached at one end to the plug 20 such as by tying, adhesive or any other suitable means. The tether 22 is adapted to exert a pulling bias on the device 10 to pull the device into a coat arm sleeve, vest, pant leg, shirt, another object or the like. The tether 22 is therefore connected at the end opposite the device 10 to a weight (where the bias is induced by gravity) and the weight position to fall into a pant leg or along the back of the performer's coat. Where the tether 22 is elastic, the end opposite the device 10 is secured, such as by a safety pin, to the inside of the performer's arm sleeve, shirt or vest. The tether 22 has a length to enable the performer, against the bias, to present and handle the device 10 before the audience.

Figure 2:
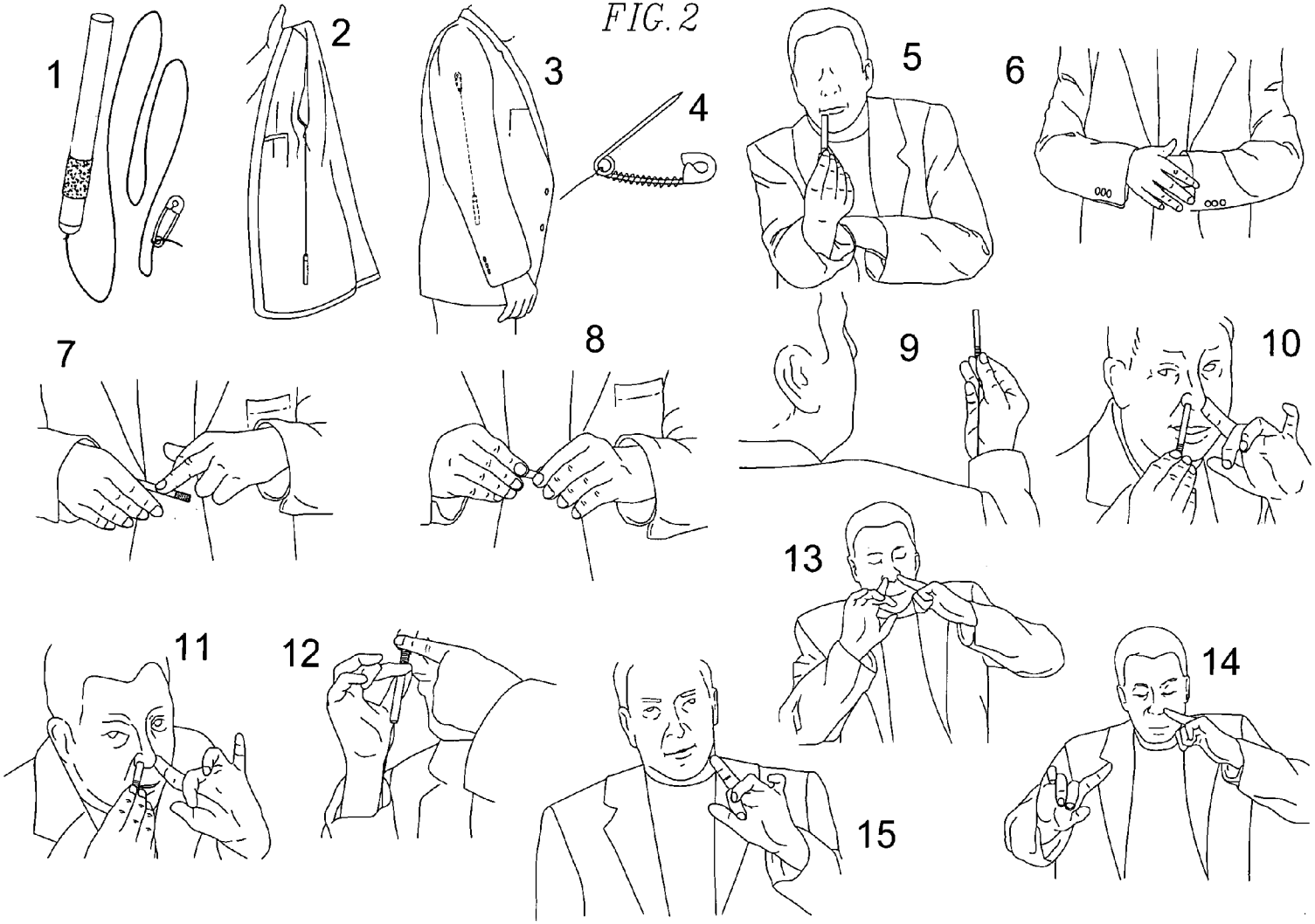
FIG. 2 illustrates the steps 1–15 for practicing the method.

To perform the trick, and with reference to FIGS. 1 and 2 and where an elastic pull is used, the performer pins the end of the tether to the inside armpit of the sleeve for the left or right arm as shown in inset 1 of FIG. 2. The performer puts on the coat as shown in inserts 2 and 3 of FIG. 2 and ensures that (a) the device 10 is concealed within the coat sleeve and (b) that the device can be withdrawn against the bias of the pull tether 22 to extend from the cuff and into the hand for manipulation before the audience. Before the audience the performer produces the device 10, e.g. cigarette, in a manner to conceal production of the device 10 from the coat sleeve.

Using a pack of cigarettes or an actual cigarette from the audience and switching to the device 10 may be a suitable ploy to enhance the illusion. In insets 5–9 of FIG. 2, the performer has pulls the device 10 from the coat sleeve and holds the device in the right hand by the plug 20 and sleeve 18. In inset 10–12 the performer positions the body 12 second end 22 proximate a nostril and slides the sleeve 18 along the body 12 to give the illusion that the device, e.g. cigarette, is being inserted into the nostril. The relative movement of the sleeve 18 embodied as a cigarette filter enhances the illusion to give the impression of relative movement. In inset 12 it is shown that the sleeve 18 has engaged the flare 22 at the second end 16, the body 12 is concealed by the performer's hand and the elastic tether 22 is stretched to exert its bias on the device 10. When the sleeve 18 reaches the second end 22 (and depending upon any embellishments the performer may wish to add), the performer releases the device 10 at which time the tether 22 pulls the device into the coat sleeve for concealment thereof. Inserts 13–15 show the final steps of the performance where the performer shows his right hand to establish that the device 10 is no longer in view. The audience is thereby convinced that the performer has inserted the cigarette into his nostril.

The device 10 may take a variety of forms including any stick object such as an ink pen, wand, or other object. For example, in an optional embodiment where the device 10 is a pen, the barrel could be the rigid body with the sleeve member configured as the pen cap. As illustrated in the optional embodiment of FIG. 1, the device 10 could be embodied as a cigarette with a rigid body made from, for example, plastic products with the filter configured as the sleeve member.

While certain embodiments of the present invention have been shown and described it is to be understood that the present invention is subject to many modifications and changes without departing from the spirit and scope of the claims presented herein.

I claim:

1. A device for a performer to perform an illusion of inserting a stick object into an ear or nostril comprising:

said stick object includes a rigid body with a first end and a second end and a distinguishable sleeve member slidable along the outside surface of said body from a first position to a position proximate said second end;

a pull including a tether coupled to said object first end and extending through a sleeve of said performer's garment, said performer holding said object exposed in one hand with said second end at said ear or nostril while moving said sleeve member along said body toward said second end to invoke the illusion of insertion of said object; and means for exerting a force by said tether on said object to pull said object into said garment sleeve for concealment thereof upon release of said object from said one hand.

2. The device of claim 1 wherein said tether is elastic, the exerting means comprising means for attaching said tether to said garment such that said tether is elastically stretched when said object is held exposed and elastically contracts to withdraw said object into said garment sleeve.

3. The device of claim 1 wherein said exerting means is a weight attached to said tether.

4. The device of claim 1 wherein said object is in the form of a filter cigarette with said sleeve member configured to appear as a filter.

5. The device of claim 1 wherein said object is in the form of a pen with said sleeve member configured to appear as a cap for a pen.

6. A method for performing an illusion of insertion of an object into an ear or nostril comprising:

providing an object having a rigid body with a first end and a second end, a distinguishable sleeve member slidable along the outside surface of said body from a first position to a position proximate said second end, and a tether secured to said object first end;

holding said object by said first end in one hand;

exerting a force by said tether urging said object to be withdrawn into a sleeve of a garment worn by the performer;

with the other hand sliding said sleeve member along said body to said second end to give the illusion of insertion of said object; and releasing said object from said one hand for withdrawal of said object into said garment sleeve.

7. The method of claim 6 wherein said object appears as a filter cigarette having a rigid body with a first end and a second end, and said sleeve member is configured to appear as a filter.

8. The method of claim 6 wherein said step of exerting a force on said object includes providing said tether as an elastic member that contracts to withdraw said object into said garment sleeve.

9. A device for a performer to perform an illusion of inserting a stick object into an ear or nostril comprising:

said stick object includes a rigid body with a first end and a second end and a distinguishable sleeve member retained on said body, said sleeve member slidable along the outside surface of said body from a first position to a position proximate said second end;

a pull including a tether coupled to said object first end and extending through a sleeve of said performer's garment, said performer holding said object exposed in one hand with said second end at said ear or nostril while moving said sleeve member along said body toward said second end to invoke the illusion of insertion of said object; and means for exerting a force by said tether on said object to pull said object into said garment sleeve for concealment thereof upon release of said object from said one hand.

* * * * *